United States Patent [19]

Tommaney et al.

[11] Patent Number: 4,514,220

[45] Date of Patent: Apr. 30, 1985

[54] METHOD FOR PRODUCING STEEL IN A TOP-BLOWN VESSEL

[75] Inventors: Joseph W. Tommaney, Butler County, Pa.; Harry L. Bishop, Jr., Delmar, N.Y.

[73] Assignee: Allegheny Ludlum Steel Corporation, Pittsburgh, Pa.

[21] Appl. No.: 604,098

[22] Filed: Apr. 26, 1984

[51] Int. Cl.[3] ..... C21C 5/34; C21C 7/10

[52] U.S. Cl. ..... 75/60; 75/59

[58] Field of Search ..... 75/59, 60

[56] References Cited

U.S. PATENT DOCUMENTS

| | | | |
|---|---|---|---|
| 3,252,790 | 5/1966 | Krivsky | 75/49 |
| 3,307,937 | 3/1967 | Pihlblad et al. | 75/59 |
| 3,854,932 | 12/1974 | Bishop | 75/49 |
| 3,867,134 | 2/1975 | Shaw et al. | 75/60 |
| 4,260,415 | 4/1981 | Simmons | 75/60 |
| 4,397,685 | 8/1983 | Maddever et al. | 75/60 |
| 4,462,825 | 7/1984 | Messina | 75/60 |

OTHER PUBLICATIONS

Ledbetter, R., "Bottom Stirring in Steelmaking to Improve Quality and Economy", *Industrial Heating*, Sep. 1983, pp. 42 and 43.

*Primary Examiner*—Peter D. Rosenberg
*Attorney, Agent, or Firm*—Patrick J. Viccaro

[57] ABSTRACT

A method for producing stainless steel in a top-blown molten metal vessel having a hot metal charge to form a bath. The method comprises top blowing from a lance oxygen and/or a mixture of oxygen and inert gas onto or beneath the surface of the bath while introducing a low flow rate inert gas to the bath from beneath the surface thereof during said top blowing. The ratio of oxygen-to-inert gas is decreased progressively during top blowing. The relative flow proportion of top-blown gases and bottom-blown gases remains substantially the same throughout the process.

17 Claims, No Drawings

METHOD FOR PRODUCING STEEL IN A TOP-BLOWN VESSEL

BACKGROUND OF THE INVENTION

This invention relates to blowing processes for refining molten metal in a vessel. Particularly, the invention relates to top blowing processes for improving removal of carbon, such as in a basic oxygen process.

It is known to produce ferrous metals in molten metal vessels wherein top blowing with oxygen through a lance positioned above the bath is used. For this purpose the vessel, such as a basic oxygen furnace, is typically charged with 60 to 80% hot metal, for example, from a blast furnace and 20 to 40% of a cold charge which may be high-carbon chromium alloy and/or stainless steel scrap. Top oxygen blowing is performed until the final bath carbon level has been reduced to approximately 0.035 to 0.05%; at which time the bath temperature is typically 3400° to 3600° F. (1871° to 1982° C.). At such carbon content, which may be currently achieved by the use of a top-blown basic oxygen converter, the bath temperatures are sufficiently high that excessive refractory wear occurs and thus charging of scrap for cooling of the bath is necessary. Presently, many product specifications require carbon levels less than 0.03%. The standard basic oxygen furnace practice cannot attain such low carbon levels.

It is also known, in top-blown oxygen steelmaking processes of this type, to blend an inert gas, such as argon, with the oxygen introduced by top blowing near the end of the blowing cycle. Although the argon serves to improve the efficiency of the carbon removal, nevertheless stainless steels having carbon contents less than about 0.03% may not be commercially produced on a consistent basis.

It has also been proposed to adapt a basic oxygen converter vessel for introduction of an inert gas to the bath from beneath the surface thereof by the use of tuyeres or porous plugs arranged on or near the bottom of the vessel. One practice would involve increasing the rate of inert gas introduced from beneath the surface of the bath and decreasing the oxygen introduced by top blowing of oxygen only as the refining operation progresses in the manufacture of steels. Such a method is disclosed in concurrently filed copending application Ser. No. 604,097, filed Apr. 26, 1984. Specifically, with stainless steel manufacture wherein an inert gas introduced beneath the bath surface is employed in combination with top-blown oxygen, the ratio of oxygen-to-inert gas is relatively high during initial blowing and must be decreased as blowing progresses. Initially, the rate of oxygen introduced is significantly higher than the rate of inert gas introduced; however, at the end of the blowing the rate of inert gas introduced is significantly higher than the rate of oxygen introduced. Therefore, the tuyeres positioned in the vessel for inert gas introduction must be capable of relatively high gas flow rates.

There have been proposals by others to use top-blowing processes only including oxygen and inert gas mixtures. U.S. Pat. No. 4,397,685, issued Aug. 9, 1983, describes a top-blowing process only which includes an oxygen-inert gas mixture, adjusting the flow mixture, and lowering lance height to achieve low carbon levels. U.S. Pat. No. 3,867,134, issued Feb. 18, 1975, discloses a process of top blowing oxygen, and then a mixture of oxygen and inert gas and varying the mixture composition. U.S. Pat. No. 3,307,937, issued Mar. 7, 1967, discloses top blowing only inert gas, then a mixture of oxygen and inert gas, and then finishing only inert gas. None of these patents, however, suggest the present invention.

An object of the invention is to provide a method of producing steel wherein the same top lances are used throughout the refining process although the overall oxygen-to-inert gas ratio of the process decreases progressively.

Another object is to provide a method whereby the relative gas flow between the top lances and the tuyeres or porous plugs remains relatively constant.

An object of the invention is to provide a method for producing steel wherein a relatively low inert gas flow rate is maintained through the tuyeres of the vessel.

These and other objects of the invention, as well as a more complete understanding thereof, may be obtained from the following description and specific examples.

SUMMARY OF THE INVENTION

In accordance with the present invention, a method is provided for producing steel in a top-blown vessel having a hot metal charge forming a bath. The method includes top blowing a refining gas from a lance onto or beneath the surface of the bath. The refining gas is substantially oxygen when carbon in the bath is in excess of about 1%, and a mixture of oxygen and inert gas when carbon is less than about 1%. During and throughout the top blowing, an inert gas is introduced beneath the surface of the bath at low flow rate. As top blowing commences, an overall ratio of oxygen-to-inert gas being injected into the bath is more than 1/1. As the blowing progresses below about 1% carbon, the top-blown refining gas is a mixture of inert gas and oxygen, and then the top-blown oxygen is decreased, while increasing the top-blown inert gas so as to progressively decrease the overall oxygen-to-inert gas ratio as the carbon is reduced during blowing. The top blowing is stopped when the end carbon content is achieved and when the ratio is less than 1/1.

DETAILED DESCRIPTION OF THE PREFERRED EMBODIMENTS

The method of the present invention relates to producing steel in a top-blown molten metal vessel. The charge could be prealloyed and comprise substantially all molten metal, such as could be supplied from an electric furnace, having relatively low carbon levels. The charge may include cold charge materials, such as scrap, chromium and other materials, and have higher carbon levels. Typically, a top-blown molten metal vessel, such as a basic oxygen converter, would have a high-carbon hot metal charge and a cold material charge to form a bath.

In the practice of the invention, a top-blown basic oxygen converter may be used having a conventional lance adapted for introducing a refining gas onto or beneath the surface of the charge within the vessel and, additionally, having means, such as tuyeres and/or porous plugs, positioned on or near the bottom of the vessel for introduction of inert gas beneath the surface of the bath. The lance may be suspended above the bath or be a type capable of being submerged within the bath, both of which practices are conventional and well known in the art. Further, in accordance with the invention, at the outset of the blowing cycle the refining gas introduced by top blowing through the lance has a high ratio of oxygen-to-inert gas. The inert gas may be solely provided through the bottom tuyeres at this stage. Initially, the top-blown gas may be 100% oxygen to achieve an overall oxygen-to-inert gas ratio of 20 to 1 or more. The overall ratio accounts for all the gases introduced into the bath from both the top and bottom. This ratio is changed progressively during blowing by progressively decreasing the ratio of oxygen-to-inert gas in the top-blown gas mixture and thus decreasing the overall ratio of oxygen-to-inert gas. At the conclusion of blowing, there is a relatively low overall ratio of oxygen-to-inert gas. Simultaneously with the top blowing, a relatively low flow rate of inert gas is introduced and maintained beneath the surface of the bath; preferably, the rate is substantially constant. It should be understood that the method of the invention may be only a part of a production process wherein no inert gas is introduced beneath the bath surface, such as through tuyeres and/or porous plugs, before or after using the method of the invention. It is also intended that the inert gas may be introduced beneath the surface intermittently during top blowing.

In the manufacture of stainless steel, for example, it is necessary that the ratio of oxygen-to-inert gas be decreased as the blow progresses. As this is achieved through the gas blown from the top through the lance, it is not necessary to have inert gas flow rates through tuyeres or other means beneath the surface of the bath in excess of the flow rates necessary to produce steels requiring relatively lower inert gas flow rates, such as low alloy, carbon steel. Therefore, the method of the invention may be used in the manufacture of stainless steel in vessels that are also suitable for the manufacture of a variety of steels. The inert gas introduced from beneath the surface of the bath would be maintained at a substantially constant rate. More specifically, for about 80-ton heats, the inert gas flow beneath the surface may be within the range of approximately 50 to 1500 normal cubic feet per minute or on a tonnage basis, these convert to 0.625 to 18.75 NCFM/ton, or approximately 0.5 to 20 NCFM/ton.

The inert gas introduced into the molten bath serves primarily two purposes. First, the inert gas dilutes the carbon monoxide (CO) formed during decarburization. When an inert gas, such as argon, is mixed with the carbon monoxide, the partial pressure of the carbon monoxide is reduced and the carbon-plus-oxygen reaction is favored over metallic oxidation, such as the chormium-plus-oxygen reaction. As the carbon level in the bath is reduced, more inert gas is required to maintain this relationship. Second, the bottom inert gas flow is used to produce stirring of the bath. Such stirring tends to promote mixing of the bath to facilitate homogeneity and to avoid stratification of metallics in the bath. The bottom inert gas flow is maintained at a low rate which may change slightly during the process. For example, it may be desirable to increase the bottom inert flow slightly as the bath temperature increases in order to cool the tuyeres sufficiently to avoid excessive wear and erosion of the tuyere tip.

The ratio of oxygen-to-inert gas could be about 20/1 or more at the outset and would progress to about $\frac{1}{3}$ or lower at the end of the blowing cycle. More specifically in this regard, the oxygen-to-inert gas ratio would initially be about 20/1 until the carbon in the bath is reduced to about 2%, preferably 1%, at which time the ratio would be about 3/1 until the carbon in the bath is reduced to about 0.5%, then the ratio would be about 1/1 until carbon in the bath is reduced to about 0.08% and thereafter the ratio would be about $\frac{1}{3}$ until blowing is ended and a desired carbon content is achieved. In some instances it is desirable to use 100% oxygen in the top-blown gas initially and/or to use 100% inert gas as the final stage of top blowing the refining gas. The progressive changing of the ratio may be accomplished in a step-wise manner, such as at the above-mentioned values, or continuously and incrementally so as to achieve the desired ratio values at specific carbon levels. By the practice of the present invention, carbon contents less than about 0.03% may be achieved.

The inert gas, as used herein, is substantially nonreactive with the molten metal and could be argon, nitrogen, xenon, neon and the like, and mixtures thereof. It is understood that nitrogen, although identified as an inert gas herein, could react with any nitride-forming constituents remaining in the bath. The process may also include other suitable gases which could include endothermic gases, such as carbon dioxide. As used herein, "inert gas" includes endothermic gases. The inert gas used throughout the process of the present invention may be a single gas, or a mixture of gases which can have the same or varied composition throughout the blowing cycle in order to achieve the desired final carbon level. The inert gas in the top-blown mixture may be the same as or different from the inert gas introduced beneath the bath surface during any portion of the blowing cycle.

It is also contemplated that air may be used to supply some or all of the oxygen-inert gas mixture of top-blown refining gas introduced into the vessel. Dry air may be used to supply a mixture of primarily oxygen and nitrogen to the lance for top blowing. Dry air may be used alone or in combination with oxygen gas and/or inert gases through the top lance to achieve the desired oxygen-to-inert gas ratio in the top-blown gas. As used herein, the term "dry air" means air satisfying the conditions disclosed in U.S. Pat. No. 4,260,415, issued Apr. 7, 1981, to the Assignee of the present application.

As it is described, conventional lances may be used. Conventional lances are designed for specific flow rates and molten metal bath penetration. One preferred feature of the present invention is that substantially the same total flow rate of oxygen or oxygen and inert gas mixtures is maintained through the lance throughout the entire process although the top refining gas composition is varied by decreasing oxygen and increasing the inert gas content. As a result, the same top lance may be used throughout the refining process as long as the total flow rate is substantially the same and within the designed flow rate range of the lance. For purposes hereof, a regular lance designed for a flow rate of 4000 to 7000 NCFM is suitable. On a tonnage basis the range converts to 50 to 87.5 NCFM/ton, or approximately 50 to 100 NCFM/ton. As a corollary, the relative proportion of the flow rate of top-blown gas and the flow rate of bottom inert gas is substantially the same throughout the blowing process. It is also contemplated by this invention that the total flow rate of the top-blown refining gas may increase or decrease during the process.

By way of specific example and for comparison with the practice of the invention, AISI Types 405DR, 409 and 413 stainless steels were produced using (1) a standard BOF practice wherein oxygen was top blown onto and beneath the surface of the bath; (2) mixed gas top blowing in a BOF wherein oxygen was blown from a lance onto and beneath the surface of the bath and argon gas was mixed with oxygen from the lance near the end of the blowing cycle; and (3) AOD refining wherein a combination of oxygen and argon was introduced to the melt to lower carbon to the final desired level.

To determine the relative efficiencies of these various melt practices, a determination was made of the metallic oxidization factors. The key criteria for melting efficiency is the metallic oxidization factor which is defined as the percentage of the bath composition, other than carbon and silicon, which is oxidized during blowing. The standard method for determining the metallic oxidization factor assumes that the end product of the carbon-oxygen reaction is 100% CO or that the $CO/CO_2$ ratio is known. The factor is then calculated by subtracting the amount of oxygen reacting with known carbon and silicon from the total oxygen blown to determine the total oxygen used to oxidize metallics. Based on the product of the total charge, the percent of oxidized metallics is found. It is desirable that metallic oxidation factors be kept as low as possible.

TABLE

| | Heat No. | Type | End Blow Temp. (°F.) | End Blow % C | After Reduction % C | *Final % C | Metallic Oxidization Factor |
|---|---|---|---|---|---|---|---|
| Standard BOF | 130102 | 409 | 3540 | — | .038 | .039 | 8.5 |
| | 130125 | 409 | 3575 | — | .036 | .042 | 8.4 |
| | 130149 | 409 | 3560 | — | .042 | .048 | 7.9 |
| | 130273 | 409 | 3570 | — | .040 | .040 | 8.3 |
| | Average | | 3561 | — | .039 | .042 | 8.3 |
| Mixed Gas Top Blown | 129151 | 405DR | 3390 | .028 | .031 | .035 | 7.6 |
| | 229680 | 405DR | 3350 | .025 | .035 | .033 | 8.0 |
| | 130100 | 405DR | 3370 | .010 | .024 | .024 | 8.1 |
| | 129978 | 405DR | 3320 | .028 | .049 | .049 | 8.0 |
| | Average | | 3358 | .023 | .035 | .035 | 7.9 |
| AOD | 871371 | 413 | — | — | .021 | .012 | 4.2 |
| | 871566 | 413 | — | — | .015 | — | 4.1 |
| | 871555 | 413 | — | — | .014 | .021 | 3.1 |
| | 871444 | 413 | — | — | .013 | .014 | 3.6 |
| | Average | | — | — | .016 | .016 | 3.8 |
| Top Mixed Gas Bottom Inert (Present Invention) | 190770 | 413 | 3240 | .011 | .014 | .023 | 5.5 |
| | 190771 | 413 | 3250 | .014 | .013 | .022 | 5.5 |
| | 190772 | 413 | 3255 | .013 | .010 | .017 | 5.5 |
| | 191250 | 413 | 3290 | .012 | .025 | .029 | 5.5 |
| | 191251 | 413 | 3240 | .011 | .016 | .025 | 6.3 |
| | 191252 | 413 | 3250 | .010 | .014 | .016 | 7.0 |
| | 191253 | 413 | 3290 | .012 | .016 | .030 | 6.3 |
| | Average | | 3259 | .012 | .015 | .023 | 5.9 |

*Carbon aim in all cases was less than .030%

The standard BOF heats reported in the Table of AISI Type 409 stainless steel were produced from an 80-ton batch of approximately 70–80% hot metal and 20–30% high carbon chromium alloy and stainless steel scrap. Oxygen blowing was at a rate of about 6500 NCFM (normal cubic feet per minute) from a top lance located above the bath a distance within the range of 30 to 80 inches. Oxygen blowing was continued to the turndown or end blow temperature reported in the Table.

The mixed gas top-blown AISI Type 405 heats were similarly produced except that argon was blended with the oxygen near the end of the blow in accordance with the following schedule:

| Total $O_2$ (NCF) | $O_2$ Flow Rate (NCFM) | Ar Flow Rate (NCFM) |
|---|---|---|
| 0 to 135,000 | 6,500 | 0 |

-continued

| Total $O_2$ (NCF) | $O_2$ Flow Rate (NCFM) | Ar Flow Rate (NCFM) |
|---|---|---|
| 135,000 to 145,000 | 4,800 | 2,400 |
| 145,000 to 160,000 | 3,500 | 3,500 |
| 160,000 to 170,000 | 2,400 | 4,800 |

The four AOD heats of AISI Type 413 stainless steel were conventionally produced by refining with a combination of oxygen and agron.

The present invention comprises a combined blowing technique in which oxygen-inert gas mixtures are blown from a top lance concurrent with the introduction of inert gas from a bottom tuyere or porous plug during the refining. Seven heats of AISI Type 413 stainless steel heats refined in such a manner were used to demonstrate the effectiveness of the combined blowing technique of the present invention.

Inert gas was introduced through three tuyeres located in the vessel bottom. The total bottom flow rates during the blow ranged from 110 to 560 NCFM. Oxygen or mixtures of oxygen and inert gas were blown through the lance at total flows of 6300 to 6500 NCFM according to the following schedule.

| Overall Ratio $O_{2/1}$ | | Approximate Bath C % | Top Flow Rate NCFM | Bottom Inert Flow Rate NCFM |
|---|---|---|---|---|
| 20/1 | to | 1.0–1.25 | 6500 (all $O_2$) | 110–300 |
| 3/1 | to | 0.40–0.50 | 6500 (5100 $O_2$ + 1400 Ar) | 300 |
| 1/1 | to | 0.08–0.10 | 6300–6500 (about 3400 $O_2$ + 3100 Ar) | 300–400 |
| 1/3 | to | 0.01–0.02 | 6300–6500 (about 1700 $O_2$ + 4800 Ar) | 300–560 |

The first three heats were produced by charging a nominal 140,000 pounds of 3% C and 1% Si hot metal to the vessel, which contained 30,000 pounds of 62% high carbon ferrochromium. The last four heats were similarly charged except that about 130,000 pounds of hot metal and 35,000 pounds of 52% high carbon ferrochromium were used. Approximately one minute after the start of blowing, 3000 pounds of dolomite and 5000 to 7000 pounds of burnt lime were added to the vessel. A reduction mixture consisting of pure aluminum, for the first heat, 75% ferrosilicon, for the second and third heats, and 50% ferrosilicon for the balance of the heats and lime (if required) in a quantity sufficient to reduce the chromium oxide level of the slag from about 50% to about 5% was added after the end of blowing.

With respect to achieving the desired carbon aim of 0.03% or less, it may be seen from the Table that both the AOD processed heats and the heats processed by the top mixed gas-bottom inert gas blowing method of this invention easily achieved this carbon level; whereas none of the conventionally-produced BOF heats met the 0.03% carbon maximum requirement. It may be observed that all of the top mixed gas blown heats were below that 0.03% carbon level at the end of the blow cycle, but only one of the heats was less than this value at final analysis. This indicates a stratification of carbon in the bath which results from lack of stirring action of the type achieved with the top and bottom blowing practice of the present invention.

Of the various melting practices reported, only the conventional BOF practice produced excessive temperatures from the standpoint of causing undue refractory wear and requiring the addition of cold scrap for cooling of the bath. For the present invention the typical bath temperature at the end of the blow is below 3300° F., and preferably between 3100°-3300° F. (1704.5°-1815.5° C.), which improves the refractory wear-life.

As was an object, the present invention is a method for producing steels consistently and reproducibly having carbon contents less than about 0.03%. The method has the advantage of improved efficiency and reduced oxidization of valuable metallics, such as chromium, in the charge while having end blow temperatures below 3300° F. to improve refractory wear-life. The method of the present invention is useful for retrofitting existing equipment, such as BOFs, without the capital expenditures required for all new equipment, and can be implemented using conventional top lances and bottom tuyeres and/or plugs.

Although preferred and alternative embodiments have been described, it will be apparent to those skilled in the art that changes can be made therein without departing from the scope of the invention.

What is claimed is:

1. A method for producing steel in a top-blown molten metal vessel having a hot metal charge to form a bath, the method comprising:

top blowing a refining gas from a lance onto or beneath the surface of the bath;

said refining gas being substantially oxygen when carbon in the bath is in excess of about 1%, and being a mixture of oxygen and inert gas when carbon in the bath is less than about 1%;

introducing inert gas at a low flow rate to the bath from beneath the surface of the bath during said top blowing;

establishing an overall ratio of oxygen-to-inert gas being injected into the bath of more than 1/1 when top blowing commences;

decreasing the top-blown oxygen while increasing the top-blown inert gas so as to decrease the overall ratio of oxygen-to-inert gas progressively as the carbon is reduced during said top blowing; and stopping said top blowing when the desired carbon content is reached and with said ratio being less than 1/1.

2. The method of claim 1 wherein during said top blowing said inert gas introduced from beneath the surface of the bath is maintained at a substantially constant rate relative to said progressively decreasing ratio of oxygen-to-inert gas in said top-blown gas mixture.

3. The method of claim 2 wherein said inert gas introduced from beneath the surface of the bath is maintained at a substantially constant rate within the range of 0.5 to 20 cubic feet per minute per ton.

4. The method of claim 1 wherein the overall ratio of oxygen-to-inert gas is decreased from about 20/1 or more to $\frac{1}{3}$ or lower progressively during said top blowing.

5. The method of claim 4 wherein during said top blowing the ratio of oxygen-to-inert gas is maintained at about 20/1 or more until carbon in said bath is reduced to about 1%, about 3/1 until carbon in said bath is reduced to about 0.5%, about 1/1 until carbon in said bath is reduced to about 0.08% and about $\frac{1}{3}$ or lower until top blowing is ended and a desired carbon content is achieved.

6. The method of claim 1 wherein said desired carbon content is less than about 0.03%.

7. The method of claim 1 wherein said inert gas introduced to said bath is an inert gas selected from the group consisting of argon, nitrogen, xenon, neon, carbon dioxide and mixtures thereof.

8. The method of claim 1 wherein the bath temperature at the end of the blow is less than 3300°F.

9. The method of claim 1 wherein top blowing of the refining gas is maintained at substantially the same total flow rate during top blowing while the oxygen and inert gas composition is varied.

10. The method of claim 1 wherein the relative proportion of the flow rate of top-blown gas to the flow rate of inert gas introduced beneath the bath surface is substantially the same throughout the blowing steps.

11. The method of claim 1 wherein said inert gas is introduced from beneath the bath surface before commencing said top blowing.

12. The method of claim 1 wherein said refining gas is all oxygen when carbon in the bath is in excess of about 2%, and is a mixture of oxygen and inert gas when carbon is less than about 2%.

13. The method of claim 1 wherein said top-blown refining gas is all inert gas at the final stage of blowing when the final carbon achieved is less than 0.03%.

14. The method of claim 1 wherein all or part of the oxygen-inert gas mixture of the top-blown refining gas is provided as dry air.

15. The method of claim 1 wherein the bath contains a high carbon hot metal charge and a cold material charge.

16. In a method for producing steel in a top-blown molten metal vessel having a high-carbon hot metal and chromium-containing alloy charge to form a bath, which method decarburizes the molten bath to desired carbon content by top blowing a refining gas of oxygen and/or an oxygen and inert gas mixture from a lance onto or beneath the surface of the bath, wherein the improvement comprises:

top blowing a refining gas of substantially oxygen when carbon in the bath is in excess of about 1% and a mixture of oxygen and inert gas when carbon in the bath is less than about 1%;

continuously introducing an inert gas at a flow rate to the bath from beneath the surface;

establishing an overall ratio of oxygen-to-inert gas being introduced to the bath of more than 1 to 1 when top blowing commences;

decreasing the top-blown oxygen while increasing the top-blown inert gas so as to decrease the overall ratio of oxygen-to-inert gas progressively as the carbon is reduced during top blowing, while maintaining the top-blown refining gas at substantially the same total flow rate;

stopping said top blowing with the ratio being less than 1/1.

17. A method for producing steel in a top-blown molten metal vessel having a hot metal charge to form a bath, the method comprising:

top blowing a refining gas from a lance onto or beneath the surface of the bath;

said refining gas being substantially oxygen when carbon in the bath is in excess of about 1%, and being a mixture of oxygen and inert gas when carbon in the bath is less than about 1%;

introducing inert gas at a low flow rate to the bath from beneath the surface of the bath during said top blowing;

establishing an overall ratio of oxygen-to-inert gas being injected into the bath of more than 1/1 when top blowing commences;

decreasing the top-blown oxygen while increasing the top-blown inert gas while maintaining substantially the same total flow rate of top-blown refining gas so as to decrease the overall ratio of oxygen-to-inert gas progressively as the carbon is reduced during said top blowing;

maintaining substantially the same relative proportion of the flow rate of top-blown gas to the flow rate of inert gas introduced beneath the bath surface throughout the blowing steps; and stopping said top blowing when the desired carbon content is reached and with said ratio being less than 1/1.

* * * * *